US005316056A

United States Patent [19]

Stott

[11] Patent Number: 5,316,056

[45] Date of Patent: May 31, 1994

[54] POWDER DISPENSING APPARATUS

[75] Inventor: Leslie Stott, Bacup, England

[73] Assignee: L. E. Stott Limited, Bacup, England

[21] Appl. No.: 969,486

[22] Filed: Oct. 30, 1992

Related U.S. Application Data

[63] Continuation-in-part of Ser. No. 938,777, Sep. 2, 1992, abandoned, which is a continuation-in-part of Ser. No. 658,925, Mar. 14, 1991, abandoned.

[51] Int. Cl.[5] ..... B65B 1/28

[52] U.S. Cl. ..... 141/68; 141/59; 141/65; 141/83; 141/93; 141/286; 141/313

[58] Field of Search ..... 141/10, 59, 65, 67, 141/68, 70, 83, 93, 114, 286, 287, 290, 312-315, 317; 55/302, 303

[56] References Cited

U.S. PATENT DOCUMENTS

| | | | |
|---|---|---|---|
| 2,642,215 | 6/1953 | Carter | 141/286 |
| 3,258,041 | 6/1966 | Lau | 141/10 |
| 3,384,134 | 5/1968 | Hillerns | 141/10 |
| 3,605,826 | 9/1971 | Carter | 141/286 |
| 3,693,672 | 9/1972 | Hiland | 141/7 |
| 3,707,172 | 12/1972 | Obara | 141/59 |
| 3,785,410 | 1/1974 | Carter | 141/10 |
| 3,788,368 | 1/1974 | Geng et al. | 141/67 |
| 4,047,546 | 9/1977 | Bassendale et al. | 141/67 |
| 4,312,388 | 1/1982 | Hager et al. | 141/1 |
| 4,478,262 | 10/1984 | Auer | 141/114 |
| 4,574,851 | 3/1986 | Lepisto | 141/68 |
| 4,648,432 | 3/1987 | Mechalas | 141/68 |
| 4,825,913 | 5/1989 | Stott | 141/59 |
| 4,872,493 | 10/1989 | Everman | 141/59 |
| 4,976,296 | 12/1990 | Pope | 141/59 X |
| 5,052,451 | 10/1991 | Gentilcore et al. | 141/67 |

FOREIGN PATENT DOCUMENTS

| | | | |
|---|---|---|---|
| 0032481 | 7/1981 | European Pat. Off. | 141/286 |
| 0058805 | 9/1982 | European Pat. Off. . | |
| 0257683 | 3/1988 | European Pat. Off. . | |
| 0443349 | 8/1991 | European Pat. Off. . | |
| 2194607 | 3/1974 | France . | |

*Primary Examiner*—J. Casimer Jacyna
*Attorney, Agent, or Firm*—Darby & Darby

[57] ABSTRACT

An apparatus for transferring powder from a bulk supply to a container comprising a first conduit 4 extending from a bulk supply 2 to the container 25, a second conduit 8 enabling the introduction of a purge gas into the container, a third conduit 28 enabling displaced gas to discharge from the container, a source of suction 17 communicating with the third conduit, a filter 13 through which passes the displaced gas, and an inflatable annulus 23 made of flexible material disposed round the conduits and adapted to enter into enter into engagement with the wall of the container.

6 Claims, 3 Drawing Sheets

POWDER DISPENSING APPARATUS

CROSS-REFERENCE TO COPENDING APPLICATIONS:

This is a continuation-in-part of U.S. Ser. No. 07/938,777 filed Sep. 2, 1992, now abandoned, which is in turn a continuation-in-part of U.S. Ser. No. 07/658,925, filed Mar. 14, 1991, now abandoned.

BACKGROUND OF THE INVENTION

1. Field of the Invention

This invention relates to an apparatus for transferring particulate material such as powder granules and the like (referred to herein as "powders") from a bulk supply to flexible containers such as bags.

2. Discussion of Related Art

The transfer of powders from a bulk supply to smaller containers for marketing or storage is complicated by the fact that the flow characteristics of powders are very different from those of liquids. For example, some powders tend to be sticky and flow only with difficulty while others may be of very light and flocculent nature so that when they are poured into a container, displaced gas such as air carries with it substantial quantities of entrained powder. This can cause fire hazards if powder is flammable or financial loss or danger to health if the powder is expensive or toxic.

The filling of a large number of containers with powder from a bulk supply must for practical reasons be carried out rapidly and under conditions so that, preferably, the escape of powder is prevented or, if this is not possible, then efficient methods of powder recovery are employed. Various measures have been taken for the purposes of achieving this objective. For example, one of these involves fitting the delivery end of a filling head, which extends from the bulk supply of powder to the container to be filled with an inflatable annulus which may grip and form an air-tight seal with the mouth of the container when inflated. The powder is fed via a first conduit in the filling head. A second conduit is provided through which displaced gas containing entrained powder can pass on its way to a powder recovery station where powder can be recovered. In order to assist the process, a draught created by an exhaust fan assists the removal of displaced gas. However, in order to avoid any excessive reduction in pressure within the container, air from outside the container is allowed to enter the container, through a third conduit and merge with the effluent stream of gas leaving the container. In this way, an improvement has been effected. However, even with existing well designed machines, there is a tendency for small quantities of powder to escape.

Typical prior apparatuses for filling containers are represented by U.S. Pat. Nos. 5,052,451(Gentilcore), 3,258,041 (Lau), 4,312,388 (Hager) and 3,384,134 (Hillerns).

Gentilcore describes both exhausting of displaced gases by an extraction fan and the introduction of purge gas for flammable or reactive products. There is also described a filter in the path of the exhausted gas. It does not describe, however, the use of an ambient venting conduit, nor any means for cleaning the filters.

Hager uses nitrogen as a purge gas and also powered air extraction. Again, however, there is no direct vent to atmosphere and no means of cleaning filters.

Both Lau and Hillerns describe filling systems whereby filters are cleaned by reverse flow. Neither, however, addresses the problem of achieving such filter cleaning in combination with inert gas purging.

SUMMARY OF THE INVENTION

It is an object of the present invention to provide a filling apparatus which has a powder supply conduit, a vent conduit for venting gas from the filling container to atmosphere, an extraction conduit for powered extraction of gas from the container and a purge conduit for supplying purge gas to the interior of the container, the apparatus having an arrangement such that said filter means can be cleaned automatically in use during the filling cycle.

The invention provides an apparatus for filling flexible containers from a bulk supply comprising: a weighing base providing a support for one container during filling thereof; a filling head adapted to be disposed in sealing engaging with an upper part of the container to be filled; a powder supply conduit in the filling head adapted to conduct powder from the bulk supply to an interior space of the container; a vent conduit providing a gas flow path from the space to atmosphere via a first filter in the vent conduit; an extraction conduit connected at one of its ends to the interior space and at its other end connectable to an extraction fan, the extraction conduit having a second filter in a path of gas flow from the space into the extraction conduit; and a purge conduit, connected at one of its ends to supply of purge gas, and having the other of its ends arranged for discharging the purge gas into the extraction conduit in a purging step. The discharged purging gas thereafter flows under pressure into the container interior space via the second filter to cause cleaning thereof. The extraction of gas via the extraction conduit causing ingress of ambient gas via the vent conduit to effect cleaning of the first filter by reverse flow.

BRIEF DESCRIPTION OF THE DRAWINGS

This invention is illustrated but not restricted by the following drawings.

DESCRIPTION OF THE PREFERRED EMBODIMENT

Figure 1:
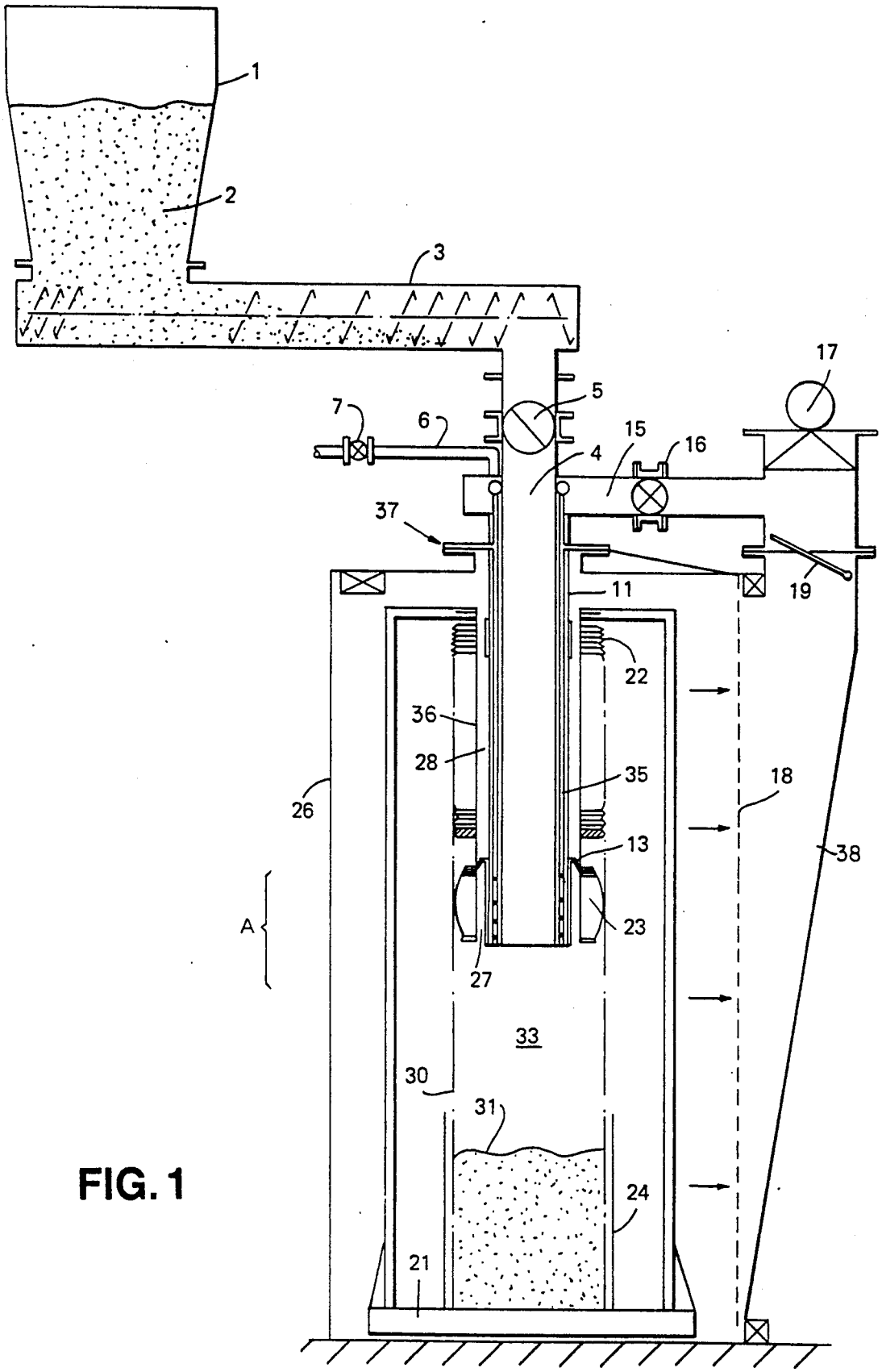
FIG. 1 is a side view taken in vertical section of one preferred form of the apparatus made according to the invention.
Figure 2:
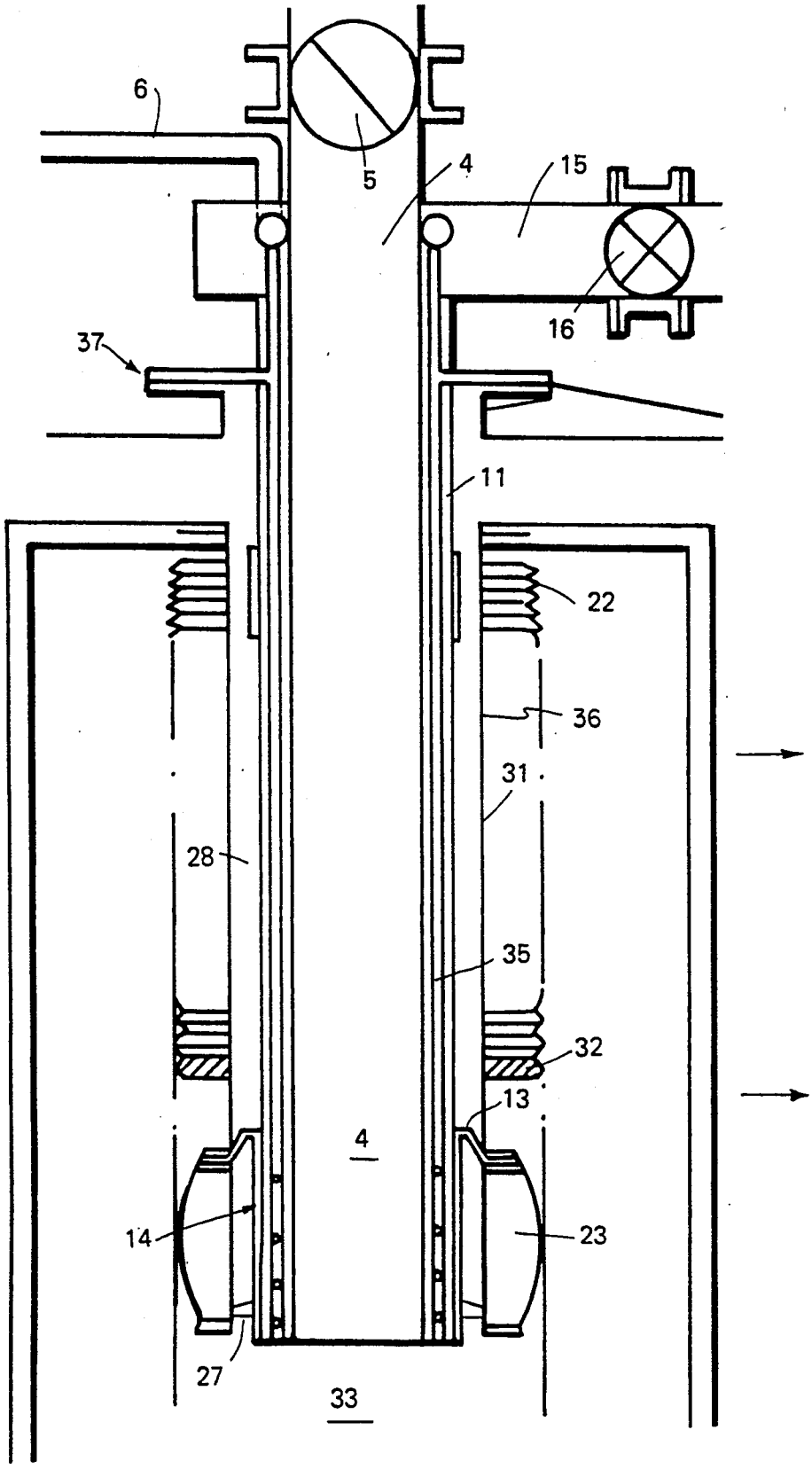
FIG. 2 is an enlargement of part of the apparatus shown as A in FIG. 1 and continuing upward to control valve 5.

A preferred embodiment of container filling apparatus of the invention is suitable for use in filling flexible containers such as individual bags, or, (in a preferred form) for filling flexible containers made from a continuous length of tubing. It will be seen that in the drawings a supply of powder or other granular material is within a hopper 2 which can be the lower end of a dryer. Although the term powder is used throughout this specification, it is to be appreciated that such term includes any particulate form of material such as granules and the like. Valve 1 controls flow of powder from hopper 2 to a screw conveyor 3 which can move the powder along a conduit to a powder flow control valve 5. Screw 3 controls the flow of powder from the hopper 2 to the valve 5 and then into the top of a powder supply conduit 4.

Conduit 4 forms part of a filling head of the apparatus but before describing the filling head in detail, other, generally conventional, features of the apparatus will be described.

The apparatus has a compartment or enclosure 26 through which the filling head passes and is sealed with the enclosure 26 at 37. The compartment 26 can be sealed in use and has a perforated wall 18 fronting an extraction plenum chamber 38 connected by ducting containing a flap valve 19 to fan 17. During the filling operation, flap 19 is open and there is major air flow via the wall 18. During final filling and closing of containers the valve 16 and 19 are operated to cause a maximum flow via conduit 15.

The filling head is supported by the compartment 26. Upstanding from a weighing base 21 is a frame 20 which mounts a tubular support 36 for tubing 22 which is shirred on to the support 36 and withdrawn via an annular spreader 32. The base 21 supports keg 24 and is connected to a weigher mechanism of conventional form. It will be appreciated that the filler head can exert little or no upward force on the weighing frame, because any such upward force would merely cause slipping of the tube downwards past the filling head.

Returning to the filling head, it will be seen that the first conduit 4 leads directly from the valve 5 to a space 33 within the container, which can be either an individual bag within the keg or a portion of the length of continuous tubing 22. At its lower end, the filling head has an inflatable annulus 23 which can form a seal with the bag or tube so as to prevent egress of gas and dust. Inside inflatable annulus 23 (which has an individual gas supply (not shown) whereby it can be inflated and deflated) there is defined the inlet 27 to an annular, vent conduit 28. During filling (between steps (12)-(14) in the following sequence), gas displaces from the space 33 to pass through inlet 27 along vent conduit 28 and to the interior of the compartment 26. This gas passes through an annular first filter 13 and then into the interior of compartment 26 to be extracted via perforated wall 18 which fronts a plenum chamber 38 connectable to fan 17 by ducting containing valve 19.

Between the powder conduit 4 and the vent conduit 28 is an annular extraction conduit 11 which leads from the space 33 to ducting 15, valve 16 and eventually fan 17. During a powder extraction phase, gas from within the space 33 passes up the extraction conduit 11 to the fan (17). As the gas leaves the space 33 and travels to the extraction conduit 11, powder extracted dust gas passes through a cylindrical second filter 14.

Figure 3:
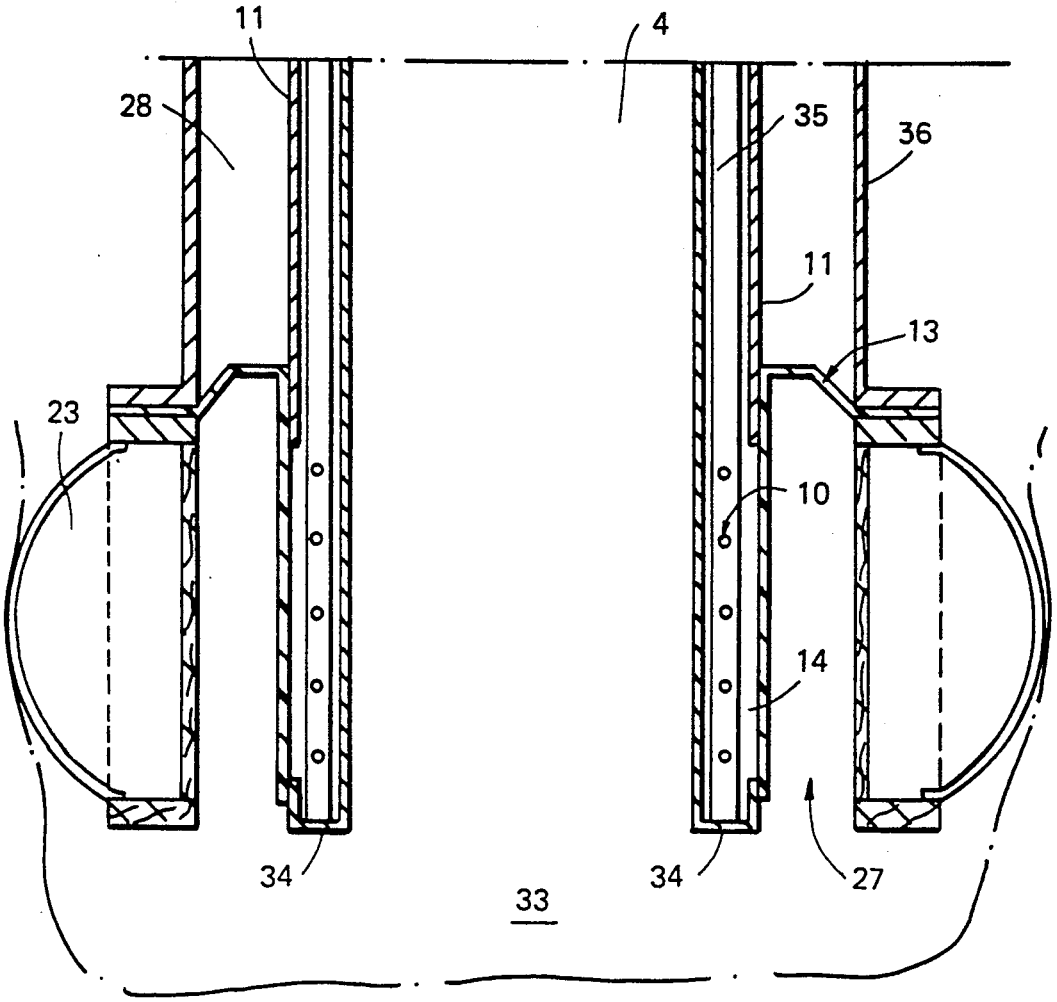
FIG. 3 is an enlarged view of part of the apparatus shown as A in FIG. 1.

The extraction conduit 11 is closed at 34 as best seen in FIG. 3 and disposed within it is a purge conduit 35 which is again hollow and annular which is connected to a purge gas supply by piping 6 which has valve 7 therein. The purge conduit 35 has, at its lower end, a plurality of apertures 10 disposed and arranged so that purge gas therefrom first pressurizes conduit 11 (where it can not exit because valve 16 is closed) and then issues in a generally uniform sheet via the cylindrical filter 14 into the space 33.

Operation of the machine and its particular advantages will become clear from the following list which is a sequential operation describing the various actions taken and the consequences which occur in the corresponding intervals which follow. Parent application Ser. No. 07/658,925, whose contents are incorporated herein by reference, describes a pre-filling phase, a filling phase, and a post-filling phase. In the following sequence, steps (1)-(5) could be described as the pre-filling phase, steps (4)-(14) could be described as the filling phase, and steps (15)-(18) could be described as the post-filling phase.

Step (1)

Fit the tubing 22 onto the support 36 by shirring, close the open end with a bag tie. This is the main process of setting up the machine in operation by putting a supply of continuous tubing 22 onto the support. The invention is not, of course, limited to the use of such tubing and instead individual bags can be used. This would, however, make the process rather more complicated and time consuming because a new bag has to be introduced each time a filled container is removed.

Interval (1)

No action.

Step (2)

Switch on fan 17. This is a preliminary step in that the fan 17 needs to operate during later steps as will be described.

Interval (2)

No action

Step (3)

Open valve 1. This allows the bulk supply of material to flow from the hopper 2 into the screw 3 and essentially primes the bulk supply for operation of the filling apparatus.

Interval (3)

Powder flows from the hopper 2 to form a choke feed to the screw feeder 3.

Step (4)

Place a fibre keg 24 with an additional prefitted plastics material liner on the base 21 beneath the filling head. This simply involves the placement of a fibre keg with an additional liner onto the base and is a normal step prior to filling.

Interval (4)

No action

Step (5)

Pull down the tied end of the continuous tubing 22 into the keg 24. The tied end of the continuous liner is pulled out into the keg. The weight of the material being filled is usually not sufficient to affect this operation and therefore it needs to be effected either manually or by a machine mechanism. Of course, instead of pulling the tied end of the continuous tubing 22 into the keg 24, a separate plastic bag could be used.

Interval (5)

No action

Step (6)

Inflate the annular seal 23. This is the first step of the filling process. The annulus 23 is inflated so as to seal the space 33 within the tubing 22. After step (6), the space 33 only communicates to atmosphere via one or other of the filters 13, 14.

Interval (6)

Annulus 23 inflates to form a seal with the tubing 22.

Step (7)

Open valve 16. This operates to draw air out of the space 33. The object of the exercise is to remove ambient air from that space so that it cannot contaminate the powder being filled. The purge gas introduced can be an inert gas such as nitrogen which will be necessary when explosive powders are being used. Here it should be noted that explosive powders can be in the nature of wood, plastics or flour and like powders which can be explosive when finely divided and mixed with air. The purge gas could also be some other inert gas if the powder concerned is an organic powder which might decay upon contact with airborne organisms. There can be a slight input of air at various stages in the process, but the majority of air within the space 33 during the filling will be the purge air which is inert. As mentioned in the foregoing, in this interval after step (7) (which could be described as the powered extraction phase) suction collapses the bag, draws out ambient air within the space 33 and causes a slight inflow via conduit 28 and filter 13. This back flow cleans filter 13 of material deposited during intervals (12) and (13) of a previous cycle.

Interval (7)

Gas within space 33 is drawn via conduit 11 and conduit 15 towards fan 17. Any particulates carried in the gas stream are deposited on the outer cylindrical surface of second filter 14, preventing escape to atmosphere and contamination of fan 17. The tubing 22 collapses due to negative pressure. The bulk of air in space 33 is removed. The reduced pressure within the space 33 allows a small quantity of air to enter via vent conduit 28 and first filter 13. This has a cleaning effect in that it removes particulate material deposited on the lower side of the first filter 13 by flow in the direction opposite to that during intervals (12) and (13).

Step (8)

Close valve 16 once sufficient evacuation has been effected. This really is as soon as the tubing 22 is effectively collapsed.

Interval (8)

Air continues to flow slowly via filter 13 until pressure equalizes.

Step (9)

Open valve 7. The purge gas such as nitrogen inflates the tubing 22 once more to fill the space 33. At the same time, the entering purge gas flows as a curtain through the central filter 14 and cleans that filter by flowing in the opposition direction to the direction in which the filter operates to retain dust during interval (7).

Interval (9)

Purge gas such as nitrogen passes along pipe 6 and into the purge conduit 35, issuing from the holes 10 and filling the extraction conduit 11. When the extraction conduit 11 is pressurized, the nitrogen issues as a curtain through the entire area of cylindrical second filter 14, effecting a cleaning of that filter by flow in a direction opposite to that of the flow through the second filter for effecting filtering during interval (7).

Step (10)

Close valve 7. This is the conclusion of the filling with purge gas. Filling ceases when the space 33 is filled with gas, that is to say the tubing 22 is fully inflated.

Interval (10)

The system remains filled with nitrogen. There is a small equalization of pressure out of filter 13 into conduit 28.

Step (11)

Operator initiates the fill procedure, for example by pressing a "fill" button.

Interval (11)

The weighing machine automatically tares.

Step (12)

Valve 5 opens. Filling starts by operation of the screw conveyor 3 feeding material through valve 5. Filling is conventionally, effected in two stages. There is a fast fill stage (determined empirically), during which a major proportion of the powder is introduced. After a pre-set time, step (13) takes place and a final dribble is initiated.

Interval (12)

Screw 3 operates at a fast rate during bulk filling. The gas within the space 33 is nitrogen. Displaced nitrogen driven out of the space 33 can only exit via filter 13, passing to ambient via second conduit 28, whose connection to ambient preserve ensures that undesirable high pressure cannot arise in space 33. Any powder entrained in nitrogen leaving is deposited on the underside of first filter 13.

Step (13)

After a pre-set time bulk filling stops and dribble is initiated.

Interval (13)

Dribble filling continues.

Step (14)

Weighing apparatus cuts off dribble. The weighing apparatus which has been carefully monitoring the weight reaches its set value and cuts off the dribble. It should be noted here that the dribble rate is dependent on the rate of operation of screw 3.

Interval (14)

No action

Step (15)

Valve 5 closes. After filling valve 5 is closed, further ingress of material is prevented.

Interval (15)

No action

Step (16)

Annulus 23 is deflated and valve 16 opens. This allows fan 17 to draw air out of the tubing 22 so as collapse it. Gas drawn out passes inwardly through filter 14 into conduit 11 and then to conduit 15. As mentioned, any entrained dust is deposited on the outer cylindrical surface of the filter 14.

Step (17)

Extraction conduit 11 draws gas from the interior space rapidly. The tubing 22 collapses around the mass of particulate material in the keg. The length of tubing 22 between the keg and the filling head collapses to a thin rope like form. During this time, gas drawn from the space 33 and from the tube passes through the second filter 14 and any entrained dust is deposited on the outer cylindrical surface thereof. With valve 16 open, the tubing 22 collapses around the filled mass 31 and forms a narrow rope-like body between the annulus 23 and the powder 31. This rope is tied twice with bag ties, clips or like fasteners and is cut between them.

Step (18)

Tubing 22 in rope-like form has a pair of spaced ties applied and is cut between them. The filled keg with contents in liner formed by part of tubing 22 is removed. An empty keg is placed in position. Thus, the filled keg and contents are removed and steps (4)–(18) are repeated. Typically a hopper 2 will be emptied completely in one filling session so as to produce a number of kegs 24 filled with the material. It may be, of course, that the user simply wants to generate a given number of kegs 24 and therefore leaves part of the bulk supply in the hopper 2. However, whether or not this takes place really does not affect the invention.

Steps (6) to (18) are repeated as is necessary to create a desired number of filled kegs from the bulk supply or to exhaust its bulk supply.

It will be seen that in the apparatus of the invention that there is a connection between the space 33 and atmosphere during the filling process. This is very important in preventing over pressures within the tubing 22 which can cause powder leakage and possible escape. Although there should really be no possibility of escape, any slight leakage (such as may occur during the aforesaid cutting process at step (18)) is extracted via a perforated wall 18 and plenum chamber 38 connected to the fan 17. An additional periodically cleanable filter (not shown) can be used upstream or downstream of the fan. However, the amount of material reaching the fan 17 is minimal and therefore repeated cleaning of such filter is not necessary.

The essence of the invention is that during the filling process the powder filled space is protected in that any flow of air outwardly therefrom has to be via filter 14 or 13. During each filling cycle (every repeat of steps (6) to (18) of the procedure), each part of the filter has a phase where it acts as a filter and has powder deposited on it and also has a second phase wherein there is gas backflow through the filter in a cleaning step. In relation to the filter 13, deposition occurs during the filling stages in intervals (12) and (13). Back flow occurs during the powdered extraction stage when valve 16 is open and the tubing 22 is collapsed during intervals (7) and (8).

In relation to the filter 14 during interval (7) and possibly 8, air is drawn rapidly up conduit 11 and conduit 15 to valve 16. During this phase, any powder entrained in such gas is deposited on the outer cylindrical surface of filter 14. However, during interval (9), purge gas enters via conduit 35 and conduit 11 and passes in a certain through the filter 14 so as to clean it.

Thus, the major filtration system of the apparatus is continually cleaned by the automatic operation of the process and there is no need for periodic cleaning or replacement of blocked filters.

Further, it is ensured by venting via vent conduit 28 that, whatever the feed rate of material for filling of containers, the pressure within the container remains approximately at ambient pressure (subject to the permeability of the filter) and that no dangerous excesses or reduction can occur during filling which might upset the sealing of the whole system.

The filter 13 prevents egress of powder during this filling stage and is subsequently cleaned during reverse flow effected during extraction of air during closing of the bag or container. Conversely, extraction of air during the closing step removes deposited material from the first filter and deposits it on the second filter. The careful arranging of the purge gas inlet so that it enters via the second filter cleans that filter at each purging step.

As will be appreciated, the two filters 13 and 14 are disposed very close together and can, desirably, be different parts of a single body. This reduces manufacturing costs and means that only a single item has to be replaced when a new filter is needed.

What is claimed is:

1. An apparatus for filling a flexible container from a bulk supply, comprising: a weighing base providing a support for a container during filling thereof; a filling head adapted to be disposed in sealing engagement with an upper part of said container to be filled; a powder conduit in said filling head adapted to conduct powder from said bulk supply to an interior space of said container; a vent conduit providing a gas flow path from said space to atmosphere via a first filter in said vent conduit; an extraction conduit with one end connected to said interior space and with another end connectable to an extraction fan, said extraction conduit having a second filter in a path of gas flow from said space into said extraction conduit; and a purge conduit, connected at one end to a supply of purge gas, the purge conduit having an other end arranged for discharging the purge gas into said extraction conduit which thereafter flows under pressure into said container interior space via said second filter to cause cleaning thereof, said extraction and vent conduits being arranged relative to each other so that extraction of gas via said extraction conduit causes ingress of ambient gas via said vent conduit to effect cleaning of said first filter by reverse flow.

2. Apparatus as set forth in claim 1, wherein said first and second filters are two parts of a single filter assembly.

3. Apparatus as set forth in claim 2, wherein said filter assembly is annular and is disposed concentrically with respect to the powder and vent conduits.

4. Apparatus as set forth in claim 3, wherein the filter is made of flexible sheet material.

5. Apparatus as set forth in claim 1, wherein said vent conduit is disposed concentrically with respect to the powder conduit.

6. Apparatus as set forth in claim 1, wherein said purge conduit is within said extraction conduit.

* * * * *